US011037711B2

(12) United States Patent
Maede et al.

(10) Patent No.: US 11,037,711 B2
(45) Date of Patent: Jun. 15, 2021

(54) SOFT MAGNETIC ALLOY POWDER, METHOD FOR PRODUCING SAME, AND DUST CORE USING SOFT MAGNETIC ALLOY POWDER

(71) Applicant: Panasonic Intellectual Property Management Co., Ltd., Osaka (JP)

(72) Inventors: Masato Maede, Kyoto (JP); Toshiyuki Kojima, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 252 days.

(21) Appl. No.: 16/019,461

(22) Filed: Jun. 26, 2018

(65) Prior Publication Data

US 2019/0013124 A1 Jan. 10, 2019

(30) Foreign Application Priority Data

Jul. 5, 2017 (JP) ..... JP2017-132078
Apr. 11, 2018 (JP) ..... JP2018-075900

(51) Int. Cl.
*H01F 1/153* (2006.01)
*H01F 27/255* (2006.01)
(Continued)

(52) U.S. Cl.
CPC ..... *H01F 1/15333* (2013.01); *C22C 45/02* (2013.01); *H01F 1/15308* (2013.01); *H01F 1/15366* (2013.01); *H01F 27/255* (2013.01); *B22F 1/0059* (2013.01); *B22F 2009/048* (2013.01); *B22F 2301/35* (2013.01); *B22F 2303/15* (2013.01); *B22F 2998/10* (2013.01); *B22F 2999/00* (2013.01); *C22C 2200/02* (2013.01); *C22C 2200/04* (2013.01)

(58) Field of Classification Search
None
See application file for complete search history.

(56) References Cited

U.S. PATENT DOCUMENTS

2009/0266448 A1 10/2009 Ohta et al.
2010/0230010 A1* 9/2010 Yoshizawa ..... H01F 1/15333 148/304

(Continued)

FOREIGN PATENT DOCUMENTS

CN 103862048 A 6/2014
JP 5445888 B 3/2014

OTHER PUBLICATIONS

Kong (J. Applied Physics, 2012, vol. 111,07A311). (Year: 2012).*

(Continued)

*Primary Examiner* — Xiaowei Su
(74) *Attorney, Agent, or Firm* — McDermott Will and Emery LLP

(57) ABSTRACT

Provided herein is a soft magnetic alloy powder that can exhibit a high saturation flux density and desirable soft magnetic characteristics. A dust core using such a soft magnetic alloy powder is also provided. A soft magnetic alloy powder is used that includes an amorphous phase, and an αFe crystalline phase residing in the amorphous phase. The αFe crystalline phase has a crystallite volume distribution with a mode of 1 nm or more and 15 nm or less, and with a half width of 3 nm or more and 50 nm or less.

6 Claims, 2 Drawing Sheets

(51) Int. Cl.

| | |
|---|---|
| ***H01F 27/28*** | (2006.01) |
| ***C22C 45/02*** | (2006.01) |
| *B22F 9/04* | (2006.01) |
| *B22F 1/00* | (2006.01) |

(56) References Cited

U.S. PATENT DOCUMENTS

| | | | |
|---|---|---|---|
| 2011/0085931 | A1 | 4/2011 | Ohta et al. |
| 2011/0108167 | A1 | 5/2011 | Ohta et al. |

OTHER PUBLICATIONS

Bitoh (Materials Transactions, 2003, vol. 44, p. 2011-2019). (Year: 2003).*
Fan (AIP Advances, vol. 7, 056107, Published in Feb. 2017). (Year: 2017).*
English Translation of Chinese Search Report dated Nov. 30, 2020 for the related Chinese Patent Application No. 201810686926.9.

* cited by examiner

RELATED ART

SOFT MAGNETIC ALLOY POWDER, METHOD FOR PRODUCING SAME, AND DUST CORE USING SOFT MAGNETIC ALLOY POWDER

TECHNICAL FIELD

The technical field relates to a soft magnetic alloy powder and a method for producing same, and to a dust core using the soft magnetic alloy powder. Specifically, the present disclosure relates to a soft magnetic alloy powder used for inductor applications such as in choke coils, reactors, and transformers, a method for producing such a soft magnetic alloy powder, and to a dust core using the soft magnetic alloy powder.

BACKGROUND

The last years have seen rapid advances in the development of electrically powered automobiles, including hybrid electric vehicles (HEVs), plug-in hybrid electric vehicles (PHEVs), and electric vehicles (EVs). For improved fuel economy, there is a demand for making smaller and lighter systems for these vehicles. The growing market for electrically powered automobiles has also created a demand for making various electronic components smaller and lighter, and there is an increasing demand for higher performance in soft magnetic alloy powders and in dust cores using soft magnetic alloy powders in applications such as in choke coils, reactors, and transformers.

For miniaturization and lightness, the materials used for soft magnetic alloy powders and dust cores using soft magnetic alloy powders require a high saturation flux density and a small core loss. Soft magnetic alloy powders, and dust cores using soft magnetic alloy powders also require desirable DC bias characteristics.

A nanocrystalline soft magnetic alloy is a soft magnetic material with a micro αFe crystalline phase precipitated in an amorphous phase, and has excellent properties satisfying both high saturation flux density and small core loss.

For example, Japanese Patent Number 5445888 describes a method for producing an Fe-based nanocrystalline soft magnetic alloy powder of nanoscale crystal grains having a high saturation flux density. A nanocrystalline soft magnetic alloy powder and a magnetic component that exhibit desirable magnetic characteristics are also described.

SUMMARY

FIG. 2 shows a schematic view of a microstructure inside the soft magnetic alloy powder described in Japanese Patent Number 5445888. The nano soft magnetic alloy powder has an αFe crystalline phase 1 having an average particle size of 60 nm or less, and the αFe crystalline phase 1 is dispersed in an amorphous phase 2 in a volume fraction of 30% or more.

However, the nano soft magnetic alloy powder includes insufficiently crystallized microcrystal grains of several nanometers or less, and enlarged crystal grains of several tens of nanometers or more. With these crystal grains, the nano soft magnetic alloy powder increases its magnetic anisotropy, and the coercive force increases. A dust core using such a nano soft magnetic alloy powder has a large core loss accordingly.

The present disclosure is intended to provide a solution to the foregoing problem of the related art, and it is an object of the present disclosure to provide a crystalline soft magnetic alloy powder that exhibits high saturation flux density and desirable soft magnetic characteristics, a method for producing such a crystalline soft magnetic alloy powder, and a dust core using the crystalline soft magnetic alloy powder.

According to an aspect of the disclosure, there is provided a soft magnetic alloy powder including an amorphous phase, and an αFe crystalline phase residing in the amorphous phase, the αFe crystalline phase having a crystallite volume distribution with a mode of 1 nm or more and 15 nm or less, and with a half width of 3 nm or more and 50 nm or less.

According to another aspect of the disclosure, there is provided a method for producing a soft magnetic alloy powder, the method including:

pulverizing an alloy composition having an amorphous phase into a powder; and heating the powder to precipitate an αFe crystalline phase so that the αFe crystalline phase has a crystallite volume distribution with a mode of 1 nm or more and 15 nm or less, and with a half width of 3 nm or more and 50 nm or less.

The means disclosed in the embodiment can reduce the coercive force of a soft magnetic alloy powder, and can provide a nanocrystalline soft magnetic alloy powder that exhibits high saturation flux density and desirable soft magnetic characteristics. A dust core using such a nanocrystalline soft magnetic alloy powder also can be provided.

DESCRIPTION OF EMBODIMENTS

Production of Soft Magnetic Alloy Powder

Figure 1:
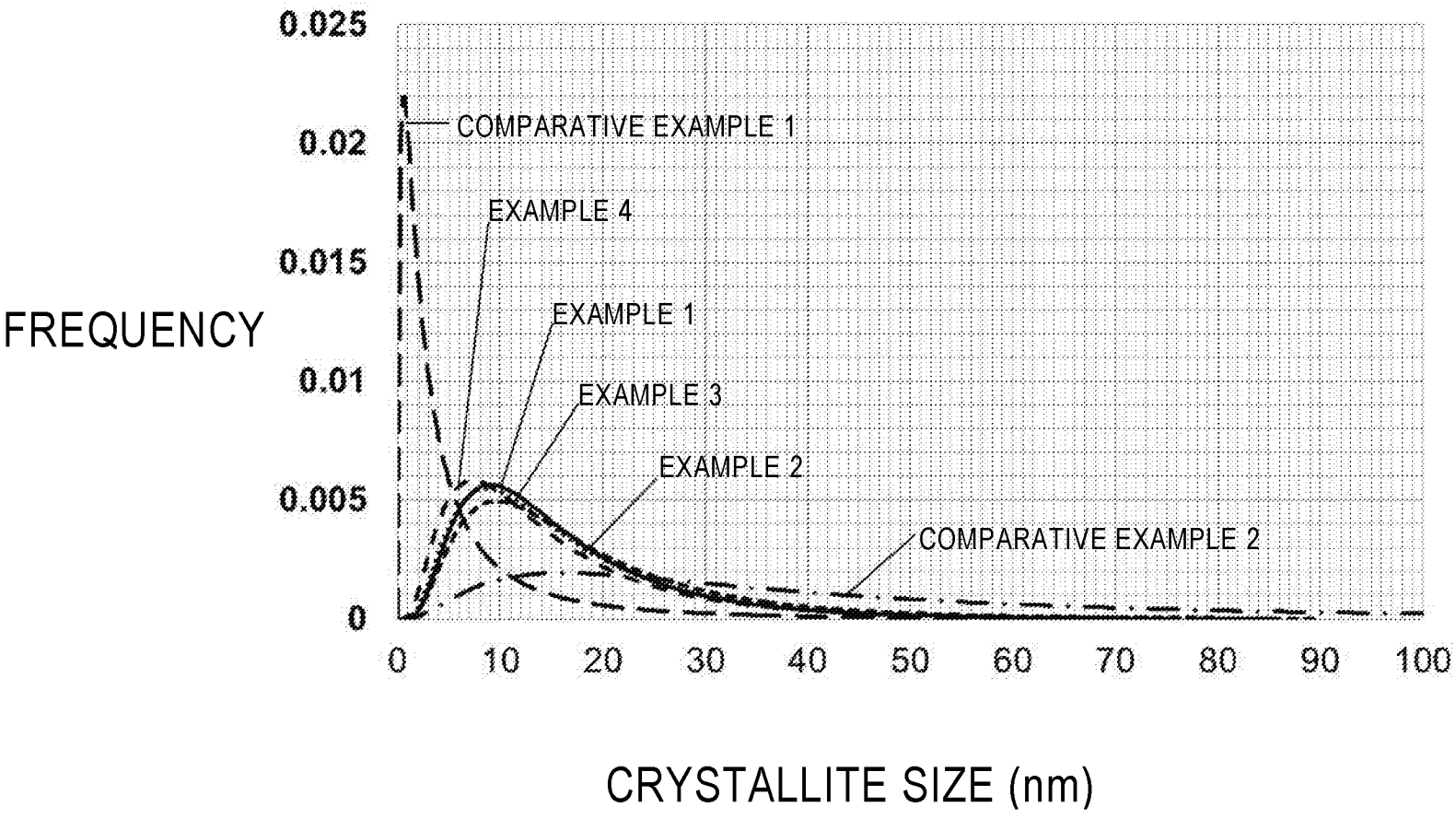
FIG. 1 is a diagram representing the crystallite volume distribution of a soft magnetic alloy powder produced according to an embodiment of the disclosure.
Figure 2:
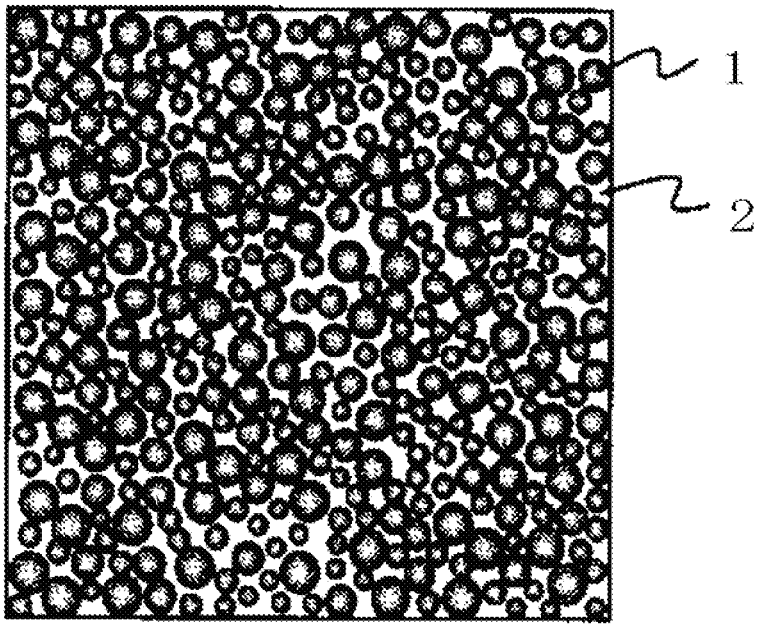
FIG. 2 is a schematic view of a microstructure inside the soft magnetic alloy powder described in Japanese Patent Number 5445888.

A method for producing a soft magnetic alloy powder of an embodiment is described first.

(1) An alloy composition that precipitates fine crystals of αFe crystalline phase is melted by means of, for example, high-frequency heating, and an amorphous-phase ribbon or sheet is produced by liquid quenching. A single-roll or twin-roll manufacturing apparatus used for manufacture of, for example, Fe-based amorphous ribbons may be used for the liquid quenching that produces the amorphous-phase ribbon.

(2) The ribbon or sheet is pulverized into a powder. The ribbon or sheet may be pulverized using a common pulverizer. For example, a ball mill, a stamping mill, a planetary mill, a cyclone mill, a jet mill, or a rotary mill may be used. After pulverization, the powder is classified with a sieve, and a soft magnetic alloy powder having a desired particle size distribution is obtained.

(3) The powder pulverized from the ribbon or sheet is then subjected to a heat treatment to precipitate the αFe crystalline phase. A heat-treatment device, for example, such as a hot-air furnace, a hot press, a lamp, a metal sheathed heater, a ceramic heater, and a rotary kiln may be used. Particularly preferably, the heat treatment is performed with a hot press from the both sides of the powder. In this way, the powder temperature can be accurately controlled.

By making the powder temperature uniform during the heat treatment, it is possible to prevent generation of insufficiently crystallized microcrystal grains of several nanometers or less, and enlarged crystal grains of several tens of nanometers or more, and crystal grains of αFe crystalline phase can precipitate in suitable sizes. The powder has a nonuniform temperature when it is simply charged into a container and placed in a furnace. With a nonuniform powder temperature, the extent of crystallization becomes different in different parts of the powder, and crystals of a nonuniform size are produced.

By making the powder temperature uniform, a crystalline soft magnetic alloy powder that can exhibit a high saturation flux density and desirable soft magnetic characteristics can be obtained.

Production of Dust Core (1) For the production of a dust core of the present embodiment, the soft magnetic alloy powder is mixed with a binder having desirable insulation and high heat resistance, such as a phenolic resin and a silicone resin, to produce a granulated powder.

(2) The granulated powder is charged into a mold of the desired shape having high heat resistance and molded under applied pressure to obtain a compact.

(3) The binder is cured under heat, and a heat treatment is performed at a temperature at which precipitation of an α crystalline phase does not occur. This produces a dust core that can exhibit a high saturation flux density and desirable soft magnetic characteristics.

Evaluation Method

Crystallite Volume Distribution

In order to obtain a crystallite volume distribution of the soft magnetic alloy powder, an X-ray diffraction profile of a powder sample is obtained using an X-ray diffraction device (XRD). The profile shape is expressed using a volume load distribution function, and a crystallite volume distribution is obtained by calculating a volume ratio with respect to the diameter.

Crystallinity

Crystallinity represents the fraction of the αFe crystalline phase in the soft magnetic alloy powder, and can be obtained from the X-ray diffraction pattern of a powder sample obtained by using an X-ray diffraction device (XRD). The diffraction pattern of the αFe crystalline phase is separated from the characteristic broad diffraction pattern of the amorphous phase. After determining the diffraction intensity for these phases, the ratio of the diffraction intensity of the αFe crystalline phase with respect to the total diffraction intensity is calculated to find crystallinity.

A RINT-Ultima (manufactured by Rigaku) was used as the X-ray diffraction device (XRD). Cu-Kα was used for x-ray irradiation. The optical system used a concentrated beam. A goniometer was used for detection.

EXAMPLES AND COMPARATIVE EXAMPLES

An Fe-based amorphous alloy ribbon of the composition Fe73.5-Cu1-Nb3-Si13.5-B9 (atomic %) prepared by single-roll quenching was pulverized using a rotary mill, and an amorphous-phase soft magnetic alloy powder was obtained. The pulverization consisted of 3 minutes of coarse pulverization, and 20 minutes of fine pulverization.

The pulverized powder was subjected to a heat treatment to precipitate an αFe crystalline phase. The heat treatment was performed in six different patterns for Examples 1 to 4 and Comparative Examples 1 and 2.

Heat Treatment

Example 1: Heated at 550° C. with a hot press for 20 seconds

Example 2: Heated at 390° C. with a hot-air furnace for 12 hours, and at 550° C. with a hot press for 7 minutes Example 3: Heated at 550° C. with a hot press for 20 seconds Example 4: Heated at 550° C. with a hot press for 20 seconds Comparative Example 1: Heated at 530° C. with a hot-air furnace for 10 minutes Comparative Example 2: Heated at 550° C. with a hot press for 20 seconds, and remelted with a thermal plasma FIG. 1 shows the frequency distribution of crystallite sizes calculated for the nanocrystalline soft magnetic alloy powders of Examples and Comparative Examples using an X-ray diffraction device (XRD). From the frequency distribution of FIG. 1, the mode and the half width were calculated for each frequency distribution of crystallite sizes. The mode is the crystallite size at the maximum frequency. Crystallinity was calculated by using the crystallinity calculation method described above.

A silicone resin was mixed as a binder, and a granulated powder was produced by granulation. The granulated powder was transferred into a mold, and molded under applied pressure to produce a compact. The silicone resin was used in about 3 weight % of the soft magnetic alloy powder.

The compacts of Examples and Comparative Examples were each measured for core loss at a frequency of 1 MHz and a magnetic flux density of 25 mT, using a B-H analyzer. Samples with a core loss of 1,300 kW/m$^3$ or less were determined as being desirable. This is to ensure that the core loss value is no greater than the core loss values of common metallic materials.

Table 1 shows the results for Examples 1 to 4 and Comparative Examples 1 and 2, specifically, the mode and the half width of the volume distribution of crystallite sizes, crystallinity, and core loss. The core loss of Comparative Example 2 was too large to be measured by the device, and was estimated to be at least 4,000 kW/m$^3$ from the result that the coercive force of the soft magnetic powder was about 4 times higher than that of Example 1.

TABLE 1

| | | Crystallite volume distribution | | | | Evaluation: Pass for |
|---|---|---|---|---|---|---|
| | Heat treatment | Mode (nm) | Half width (nm) | Crystallinity (%) | Core loss (kW/m$^3$) | core loss of 1,300 (kW/m$^3$) or less |
| Com. Ex. 1 | Heated at 530° C. with a hot-air furnace for 10 minutes | 0.69 | 2.5 | 55 | 1,745 | Fail |
| Com. Ex. 2 | Heated at 550° C. with a hot press for 20 seconds, and remelted with a thermal plasma | 16.2 | 54.7 | 49 | 4,000 or more | Fail |

TABLE 1-continued

| | Heat treatment | Crystallite volume distribution Mode (nm) | Half width (nm) | Crystallinity (%) | Core loss ($kW/m^3$) | Evaluation: Pass for core loss of 1,300 ($kW/m^3$) or less |
|---|---|---|---|---|---|---|
| Ex. 1 | Heated at 550° C. with a hot press for 20 seconds | 9.0 | 11.9 | 95 | 1,040 | Pass |
| Ex. 2 | Heated at 390° C. with a hot-air furnace for 12 hours, and at 550° C. with a hot press for 7 minutes | 9.5 | 14.2 | 86 | 1,250 | Pass |
| Ex. 3 | Heated at 550° C. with a hot press for 20 seconds (small average particle size) | 8.7 | 12.6 | 80 | 1,060 | Pass |
| Ex. 4 | Heated at 550° C. with a hot press for 20 seconds (small average particle size) | 7.3 | 12.9 | 77 | 1,054 | Pass |

Mode and Half Width of Volume Distribution of Crystal Sizes, and Crystallinity

It can be seen from the results shown in Table 1 that the core loss increases when the mode and the half width of the crystallite volume distribution are either too small or too large, and that the crystallite volume distribution has an optimum volume distribution of crystallite sizes that makes the core loss smaller. It can also be seen that the core loss decreases as the crystallinity increases.

Mode and Half Width of Volume Distribution

It is accordingly preferable that the crystallite volume distribution has a mode of 1 nm or more and 15 nm or less, and that the volume distribution of crystallite sizes has a half width of 3 nm or more and 50 nm or less.

The mode of the crystallite volume distribution is preferably 6 nm or more and 15 nm or less.

It is preferable that the mode of the crystallite volume distribution be 8 nm or more and 15 nm or less, and that the half width of the volume distribution of crystallite sizes be 10 nm or more and 20 nm or less.

It is preferable that the mode of the crystallite volume distribution be 8 nm or more and 11 nm or less, and that the half width of the crystallite volume distribution of the αFe crystalline phase be 10 nm or more and 15 nm or less.

Crystallinity

A dust core with an even smaller core loss can be obtained when the crystallinity is higher than 55%. The crystallinity is preferably 70%% or more, further preferably 80% or more.

In Example 2, the pressure resistance of the dust core was increased by increasing the thickness of the oxide film formed around the powder in a heat treatment performed for a longer time period than in Example 1.

The volume distribution of crystal sizes was slightly larger in Example 2 than in Example 1. However, the core loss was smaller than in Comparative Example 1, and satisfied the evaluation criterion. The magnetic characteristics were therefore considered desirable while the reliability remained high.

In Comparative Example 1, the crystallite size was on the order of several nanometers or less, and the powder contained large numbers of insufficiently crystallized fine grains. The crystallinity was low accordingly. In Comparative Example 2, the powder contained large numbers of enlarged crystal grains of several tens of nanometers or more, and the crystallinity was low.

That is, the nano soft magnetic alloy powders of Comparative Examples 1 and 2 had large magnetic anisotropies, and the coercive force was high. Accordingly, the core loss increases in dust cores using these nano soft magnetic alloy powders.

In Examples 1 and 2, the powder contained a small fraction of crystallites of several nanometers or less, and a small fraction of crystallites of several tens of nanometers or more. The crystallinity was high, and the magnetic anisotropy of the nano soft magnetic alloy powder was small, possibly as a result of leveling out, making the coercive force of the nano soft magnetic alloy powder smaller. Dust cores using these nano soft magnetic alloy powders can have a smaller core loss.

DISCUSSION

An aggregate of powders has a space between powders, and the thermal conductivity is low. Accordingly, in a heat treatment using a hot-air furnace, the heat does not sufficiently transfer to all powders, and the powder temperature does not sufficiently increase during the heat treatment.

On the other hand, a hot-air furnace is not heat absorbing, and thermal runaway occurs in some of the powders as a result of self-heating due to precipitation of the αFe crystalline phase. This overly increases the powder temperature during the heat treatment.

That is, in a heat treatment using a hot-air furnace, the powder temperature becomes nonuniform during the heat treatment, and this produces a mixture of large numbers of microcrystal grains of several nanometers or less, and large numbers of enlarged crystal grains of several tens of nanometers or more, and increases the coercive force of the soft magnetic alloy powder.

A heat treatment using a hot press heats the powder from above and below with hot plates, and has high thermal conductivity. It is also possible to absorb the generated heat of powder with the hot plates when the powder temperature becomes higher than the hot press as a result of self-heating due to precipitation of the αFe crystalline phase.

This makes it possible to produce a uniform temperature for all powders during the heat treatment, and to precipitate the αFe crystalline phase in optimum sizes. The result is a crystalline soft magnetic alloy powder that can exhibit a high saturation flux density and desirable soft magnetic characteristics.

FINAL NOTE

The Fe-based amorphous alloy ribbon is not limited to the ribbons of the compositions used in Examples, and may be any ribbon, provided that fine crystals of αFe crystalline phase can precipitate.

The volume distribution of crystallite sizes, and the crystallinity are also not limited to those of Examples, and the same volume distribution and crystallinity can be obtained with compositions other than the compositions of Examples.

The embodiment enables production of a nanocrystalline soft magnetic alloy powder that can exhibit a high saturation flux density and desirable soft magnetic characteristics. A dust core using the nanocrystalline soft magnetic alloy powder also can be provided.

What is claimed is:

1. A soft magnetic alloy powder comprising:

an amorphous phase; and an αFe crystalline phase residing in the amorphous phase, wherein the αFe crystalline phase has a volume-based crystal grain size distribution with a mode of 8 nm or more and 11 nm or less, and with a half width of 10 nm or more and 20 nm or less, where the mode is a grain size at a maximum frequency in the volume-based crystal grain size distribution, and the half width is a difference between a maximum crystalline grain size and a crystalline grain minimum size at a half value of the maximum frequency in the volume-based crystal grain size distribution.

2. The soft magnetic alloy powder according to claim 1, wherein the half width is 10 nm or more and 15 nm or less.

3. The soft magnetic alloy powder according to claim 1, wherein the αFe phase has a crystallinity of higher than 55%.

4. The soft magnetic alloy powder according to claim 3, wherein the αFe phase has a crystallinity of 70% or more.

5. The soft magnetic alloy powder according to claim 3, wherein the αFe phase has a crystallinity of 80% or more.

6. A dust core comprising the soft magnetic alloy powder of claim 1, and a binder.

* * * * *